US008915395B2

(12) United States Patent
Gersovitz

(10) Patent No.: US 8,915,395 B2
(45) Date of Patent: Dec. 23, 2014

(54) MULTI-COMPARTMENT CONTAINER

(76) Inventor: Gerry Gersovitz, San Francisco, CA (US)

( * ) Notice: Subject to any disclaimer, the term of this patent is extended or adjusted under 35 U.S.C. 154(b) by 975 days.

(21) Appl. No.: 12/622,853

(22) Filed: Nov. 20, 2009

(65) Prior Publication Data

US 2010/0065557 A1 Mar. 18, 2010

Related U.S. Application Data

(60) Continuation-in-part of application No. 12/415,910, filed on Mar. 31, 2009, now abandoned, which is a division of application No. 10/948,837, filed on Sep. 22, 2004, now Pat. No. 7,571,829.

(60) Provisional application No. 60/505,410, filed on Sep. 23, 2003.

(51) Int. Cl.
*B65D 25/04* (2006.01)

(52) U.S. Cl.
USPC ..... 220/504; 220/503; 220/524; 220/507

(58) Field of Classification Search
USPC ..... 220/612, 504, 503, 23.6, 23.4, 4.27, 220/507, 500, 553, 554, 527, 524; 229/125.17
See application file for complete search history.

(56) References Cited

U.S. PATENT DOCUMENTS

| | | | | |
|---|---|---|---|---|
| 861,815 | A | | 7/1907 | Cullen |
| 1,634,569 | A | | 7/1926 | Bray |
| 1,798,071 | A | | 9/1928 | Deane |
| 1,837,343 | A | | 12/1931 | Starke et al. |
| 2,073,636 | A | | 3/1937 | Holoubek |
| 2,371,173 | A | | 3/1945 | Hothersall |
| 2,553,559 | A | | 5/1951 | Eckman |
| 2,605,013 | A | | 7/1952 | Rubenstein |
| 2,611,499 | A | | 9/1952 | Mayer |
| 2,833,436 | A | | 5/1958 | Ruderian |
| 3,106,313 | A | * | 10/1963 | Kurhan ..... 206/508 |
| 3,144,152 | A | | 8/1964 | Kopp |
| 3,199,756 | A | | 8/1965 | Davy |
| 3,272,671 | A | * | 9/1966 | Gaylord et al. ..... 156/86 |
| 3,288,342 | A | * | 11/1966 | Tinker ..... 229/5.6 |
| 3,465,905 | A | | 9/1969 | Schottanes |
| 3,485,416 | A | * | 12/1969 | Fohrman ..... 222/142.1 |
| 4,078,686 | A | | 3/1978 | Karesh |
| 4,444,324 | A | | 4/1984 | Grenell |
| 4,598,832 | A | | 7/1986 | Alonso |

(Continued)

FOREIGN PATENT DOCUMENTS

FR 2701924 A1 9/1994

OTHER PUBLICATIONS

Office Action mailed Jul. 23, 2012 in U.S. Appl. No. 13/093,468, 9 pages.

(Continued)

*Primary Examiner* — Stephen Castellano
(74) *Attorney, Agent, or Firm* — Kilpatrick Townsend & Stockton LLP

(57) ABSTRACT

A multi-unit storage device wherein two separate compartments are attached together at their bottom portions. The containers are vacuum or otherwise sealed at their top portions such that when the top portions are opened, the seal is broken and access to theproducts contained therein is provided.

14 Claims, 4 Drawing Sheets

(56) References Cited

U.S. PATENT DOCUMENTS

| | | | | | |
|---|---|---|---|---|---|
| 4,890,759 | A | * | 1/1990 | Scanga et al. | 220/273 |
| 4,925,055 | A | | 5/1990 | Robbins et al. | |
| 5,258,191 | A | | 11/1993 | Hayes | |
| 5,279,841 | A | | 1/1994 | Yu | |
| 5,353,985 | A | | 10/1994 | Nageli et al. | |
| 5,385,294 | A | * | 1/1995 | Andersson et al. | 229/125.17 |
| 5,499,738 | A | | 3/1996 | Burleigh | |
| 5,630,523 | A | | 5/1997 | Wright | |
| 5,731,020 | A | | 3/1998 | Russo | |
| 5,803,294 | A | | 9/1998 | Bello | |
| 6,105,812 | A | | 8/2000 | Riordan | |
| 6,138,899 | A | * | 10/2000 | Grabher | 229/5.5 |
| 6,196,412 | B1 | | 3/2001 | Cattell | |
| 6,415,940 | B1 | | 7/2002 | Brabson | |
| 6,450,351 | B1 | | 9/2002 | Thompson | |
| 6,708,735 | B1 | | 3/2004 | Kenihan | |
| 7,571,829 | B2 | | 8/2009 | Gersovitz | |
| 2001/0040164 | A1 | | 11/2001 | Cleator | |
| 2002/0130126 | A1 | | 9/2002 | Rosenberg | |
| 2007/0012710 | A1 | * | 1/2007 | Vovan | 220/793 |
| 2007/0267416 | A1 | | 11/2007 | Eichenbaum | |
| 2009/0236346 | A1 | | 9/2009 | Hofeldt et al. | |
| 2011/0253725 | A1 | | 10/2011 | Killian | |

OTHER PUBLICATIONS

Office Action mailed Sep. 6, 2012 in Canadian Patent Application No. 2,737,981, 2 pages.

Office Action mailed Feb. 12, 2013 in U.S. Appl. No. 13/093,468, 14 pages.

* cited by examiner

MULTI-COMPARTMENT CONTAINER

CROSS-REFERENCES TO RELATED APPLICATIONS

This application is a continuation-in-part application of application Ser. No. 12/415,910, filed Mar. 31, 2009, now abandoned, entitled "Methods of Packaging Using Multi-Compartment Containers," which is divisional application of application Ser. No. 10/948,837, entitled "Multi-Compartment Container" filed on Sep. 22, 2004 and issued as U.S. Pat. No. 7,571,829 on Aug. 11, 2009, which claims priority to Provisional Application No. 60/505,410, entitled "Multi-Compartment Container," filed on Sep. 23, 2003, the disclosures of which are incorporated herein by reference in their entirety.

BACKGROUND OF THE INVENTION

1. Field of the Invention

The present invention relates to multiple compartment storage devices, and more particularly, to a multiple-unit storage device that includes two separate containers coupled together at their bottom portions in a stacked arrangement.

2. Description of the Prior Art

In the packaging of certain products where freshness is a concern, it is desirable to have the products packaged under vacuum or seal to avoid exposure to the damaging effects of the atmosphere. By way of example, one such product is coffee. Typically, coffee is packaged in a single compartment can under vacuum. When the coffee can is opened and exposed to atmospheric conditions, all of the coffee in that coffee can may lose its aroma and flavor due to the effects of oxygen and moisture in the atmosphere. Consequently, there is a need for a container that gives consumers access to an amount of sealed products without compromising the freshness of all of the contents in the container.

BRIEF SUMMARY OF THE INVENTION

Broadly, the present invention provides a multi-unit storage device where two separate containers are held together at their bottom portions. The separate containers are vacuum or otherwise sealed at their top portions such that when the top portions are opened, the seal is broken and access to the products contained therein is provided.

In accordance with one aspect of the present invention, a multi-unit storage device includes a first container having a top portion and a bottom portion, a second container having a top portion and a bottom portion, the first and second portions being permanently coupled together at their bottom portions in a stacked arrangement, and at least one removable lid for coupling to the top portions. Each of the two separate containers is individually sealed at their respective top portions.

In accordance with another aspect of the present invention, each container is a unitary body.

In accordance with a further aspect of the present invention, each container includes ribs defined within a sidewall.

In accordance with another aspect of the present invention, each container has a cylindrical sidewall and a bottom.

In accordance with yet another aspect of the present invention, the first and second containers are coupled together via welding.

In accordance with a further aspect of the present invention, the first and second containers are coupled together via an adhesive.

The present invention also provides a method of packaging at least one type of product, where the method includes providing first and second separate containers have top and bottom portions, coupling, in a permanent manner, the first and second separate containers together at their bottom portions in a stacked arrangement to form a multi-unit storage container, placing product into the first container, placing product into the second container, and vacuum sealing the two separate containers at their top portions.

In accordance with one aspect of the present invention, the product is placed into each container prior to the two separate containers being coupled together.

In accordance with another aspect of the present invention, the product is placed into each container after the two separate containers have been coupled together.

In accordance with a further aspect of the present invention, the method includes placing a removable lid over at least one top portion after that container has been sealed.

In accordance with another aspect of the present invention, a multi-compartment storage device includes two cylinders coupled with a connecting-divider to form two compartments on opposite sides of the connecting divider.

In accordance with yet another embodiment of the present invention, a multi-compartment storage device includes a single cylinder and a dividing wall disposed therein to define two compartments on either side of the divider wall inside the cylinder.

Other features and advantages of the present invention will be apparent upon review of the following detailed description of exemplary embodiments.

DETAILED DESCRIPTION OF THE INVENTION

Figure 1:
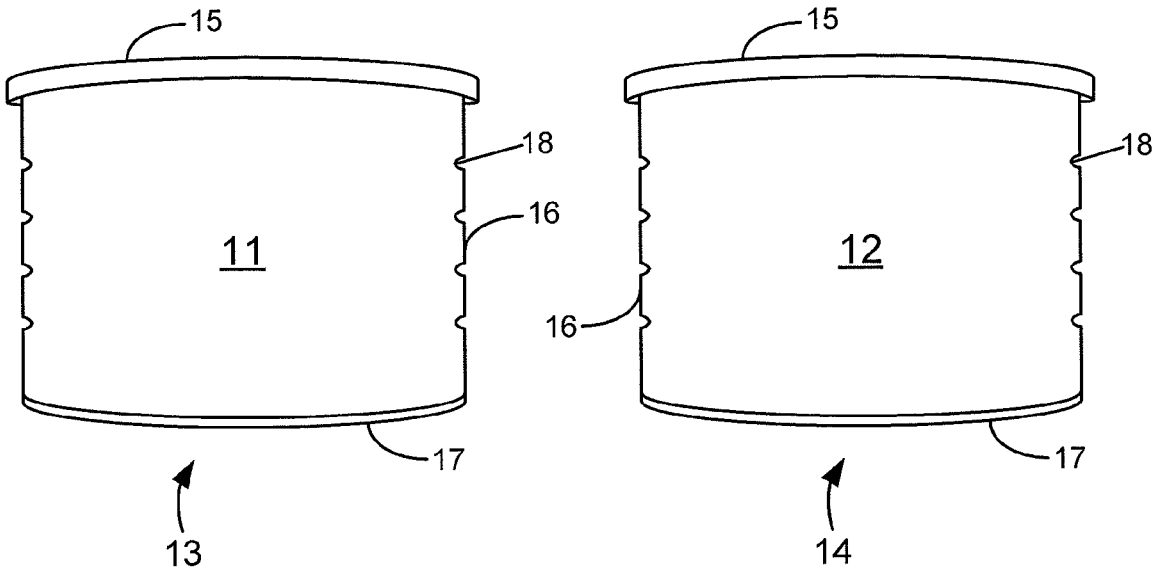
FIG. 1 is an elevation view of two containers for a multi-unit storage device in accordance with an embodiment of the present invention.
Figure 2:
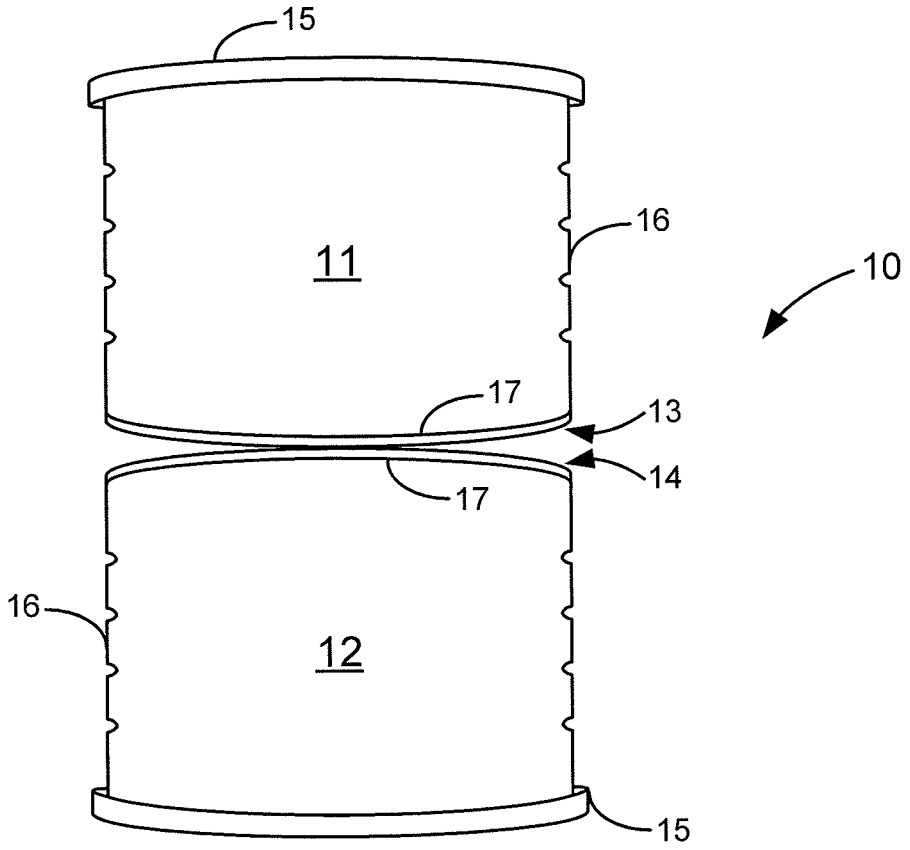
FIG. 2 is an elevation view of the two containers forming a multi-unit storage device in accordance with an embodiment of the present invention.

With reference to FIGS. 1 and 2, a multi-unit storage device 10 in accordance with an embodiment of the present invention is illustrated. The multi-unit storage device consists of two containers or cans 11, 12. The containers may be made of metal, in which case they are welded together at their bottom portions 13, 14. Glue or some other type of adhesive may also be used.

The top portions can be sealed with either metal, foil, plastic or any other suitable material. Examples for the two separate containers include coffee cans, nut cans, potato chip cans and other types of snacks. Lids 15 can be provided for closing or resealing the cans 11, 12.

The separate cans may be made using many manufacturing techniques. Early methods of making such cans included rolling a metallic body or sidewall 16 and coupling a metallic bottom 17 to the body portion with a folded or sealed flange. Additionally, the bottom may be coupled to the rolled body with a welding-type process. Modern methods include stamping or forming the bottom and body as a unitary body.

In some embodiments, ribs or troughs 18 may be defined circumferentially in the body or sidewall to provide extra strength and stability.

Another example of a type of container that may be used as the containers to form the multi-unit storage device in accordance with the present invention includes a cardboard or plastic body 16 with a metal, or plastic bottom 17. The containers may also be made as a unitary body of plastic or other suitable material. Examples of such a container include orange juice cans, nut cans, coffee, some potato snack cans and other snack cans.

In use, two containers 11, 12 as described above are provided and are coupled together at their bottom portions 13, 14. Each can, container or compartment is filled with a product and then individually vacuum, nitrogen flush or otherwise sealed. This may be done before or after the two containers are coupled to one another. Each compartment may be filled with the same product or different products. Examples of products include, but are not limited to, coffee, nuts, potato chips, candy, tea, dried fruit, etc.

When one desires access to a product, one simply opens one compartment of the container. Thus, the second compartment remains unopened, thereby protecting the product therein from the elements and helping maintain freshness. When access to the second compartment is desired, the multi-unit storage device is "flipped" and the second compartment is opened. Each compartment may be closed with lids 15 if provided. One lid may be provided and used for both containers if desired.

Additionally, each compartment may be filled with a different product if it is so desired. For example, one compartment may include potato chips while the second container may include corn chips.

Figure 3:
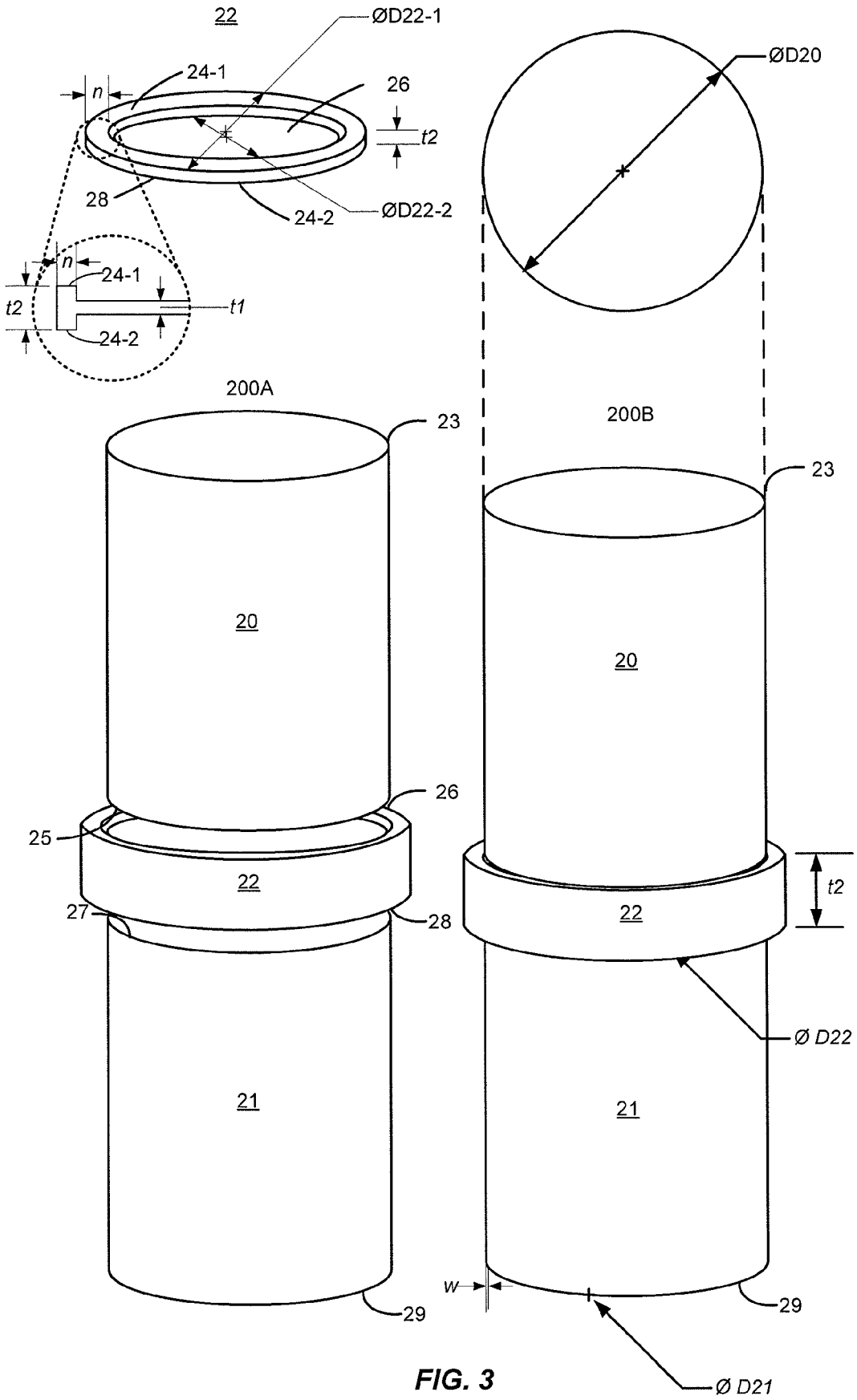
FIG. 3 is an elevation view of two cylinders and connecting-divider for a multi-unit storage device in accordance with an embodiment of the present invention.

FIG. 3 shows another embodiment according to the present invention. Elevation view 200A is the unassembled view of the multi-compartment container in elevation view 200B. As shown in FIG. 3, multi-compartment container in elevation view 200A can include a first cylinder 20, a connecting-divider 22 and a second cylinder 21. First cylinder 20 and second cylinder 21 can be made of any number of materials including, but not limited to, metal, plastic, cardboard, paper board, Mylar® and foil. In some embodiments, first cylinder 20 and second cylinder 21 can be made of a composite material that incorporate two or more of the aforementioned materials. For example, the substrate of first cylinder 20 and second cylinder 21 can include a cardboard substrate having a foil lining on the interior surface of the cylinder and a Mylar® or plastic coating on the exterior surface of the cylinder. Using or reducing the amount of metal in a container can drastically reduce the cost of producing and shipping the containers. Not only are the actual non-metal component materials less expensive, but there are many inexpensive techniques and machines that may be used for producing containers, cans, cylinders and dividers from non-metal materials.

In various embodiments, the first end 23 of the first cylinder 20 can have a top opening portion adapted to be sealed and capable of receiving a reusable lid to close the opening. Similarly, the second end 29 of the second cylinder 21 can also have a top opening portion adapted to be sealed and capable of receiving a reusable lid to close the opening. The reusable lid can be similar to the reusable lid 15 shown in FIGS. 1 and 2. The multi-compartment container or storage device pictured in FIG. 3 can be used, filled and accessed in manners similar to those described above.

In various embodiments, the first cylinder 20 and second cylinder 21 are hollow cylinders with a wall thickness, w, dimensioned to produce the structural rigidity suitable for containing and protecting products packaged therein, maintaining optional vacuum or pressure or stacking of multiple containers during shipping and display. The first cylinder can include an interior surface and an exterior surface with similar or dissimilar materials. For example, the exterior surface can be coated in a plastic film while the interior surface can be coated with a metal foil. The wall thickness, w, can depend on multiple factors, such as the intended use of the multi-compartment container, the material of the cylinders and the intended packaging method. For example, the wall thickness, w, for a cardboard cylinder can be thicker than that of a metal cylinder, especially if the resulting multi-compartment container is intended to be vacuum, pressure or nitrogen flushed sealed. Nitrogen flush sealing replaces the air inside the container to remove oxygen and moisture to help better preserve the freshness of the packaged products.

First cylinder 20 can have a first end 23 and a second end 25 and second cylinder 21 can have a first end 27 and a second end 29. Connecting-divider 22 can have a first side 26 and a second side 28 and have a unitary body construction. Multi-compartment container 200B can be assembled by attaching or coupling the second end 25 of first cylinder 20 with the first side 26 of connecting-divider 22 and attaching or coupling the first end 27 of cylinder 21 to the second side 28 of connecting-divider 22. The means of attaching or coupling the ends of the two cylinders 20 and 21 to the connecting-divider 22 can include, but are not limited to, adhesive, welding and crimping or any combination thereof.

In some embodiments, connecting-divider 22 can have lip section 24-1 on first side 26 and lip section 24-2 on second side 28. The width, n, of lip sections 24-1 and 24-2 can be defined by the difference between the diameter D22-2 of the solid inner portion of connecting-divider 22 and the outer diameter D 22-1 of connecting-divider 22. In some embodiments, diameter D22-2 can be dimensioned to slip or snug fit around the outside of diameter D20 of the first cylinder 20 and the second cylinder 21. In such embodiments, the first cylinder 20 and the second cylinder 21 can be inserted into the region defined by the lip sections 24-1 and 24-2, respectively. The lip sections 24-1 and 24-2 can be dimensioned so that the interior surface of lip sections 24-1 and 24-2 extend around the outer surfaces of first cylinder 20 and second cylinder 21, respectively. In some embodiments, adhesive can be applied to the inner surface of the lip sections or the outer surface of the cylinders ends to provide more surface area of adhesion. In other embodiments, the lip sections can be crimped or otherwise deformed so as to grab or engage the outer surfaces of the cylinders. In other embodiments, adhesive and crimping can be used to ensure a strong and airtight seal between the cylinders 20, 21 and connecting-divider 22.

The height of the lip sections can be dimensioned so as to provide additional surface area on which to apply adhesive between the connecting-divider 22 and the cylinders 20 and 21 to further strengthen the connection between the components. The height of the lip section can be defined as the difference between the thickness t1 of the solid inner portion of connecting-divider 22 and thickness t2. In some embodiments, the inner solid section of connecting-divider 22 is symmetrically arranged between lip section 24-1 and lip section 24-2. In other embodiments, the inner solid section of connecting-divider 22 can be arranged asymmetrically between the two lip sections. In some embodiments, the lip sections 24-1 and 24-2 can dimensioned with different diameters D22-2 so as to accommodate two cylinders with different dimensions such as wall thickness and diameter. For example, first cylinder 20 can have a diameter D20 and wall thickness w while second cylinder 21 can have a diameter different from diameter D20 and a wall thickness different from w.

When fully assembled, multi-compartment container 200B can have one compartment, or container, with walls of uniform diameter defined by the inner surface of cylinder 20 and a bottom defined by the first side 26 of the solid inner portion of connecting-divider 22 and another compartment, or container, with walls defined by the inner surface of cylinder 21 and the bottom defined by the second side 28 of the solid inner portion of connecting-divider 22. In some embodiments, connecting-divider 22 has no lip sections and second end 25 of the first cylinder 20 and the first end 27 of the second cylinder 21, each having some wall thickness w, are coupled to the surfaces of opposite sides of the connecting-divider 22.

In other embodiments, in which the walls are plastic or other material, the cylinders can have non-uniform diameter from one end to the other or other arbitrary shape as determined by the aesthetics or design of the packaging. For example, the plastic walls can have depressions or impressions that make it easier to hold or handle the multi-compartment container. Similarly, the compartments can any shape required by the product or the needs of the aesthetic design with two or more separately sealable/openable compartments, i.e. the shape of a cartoon character or trademark character.

Figure 4:
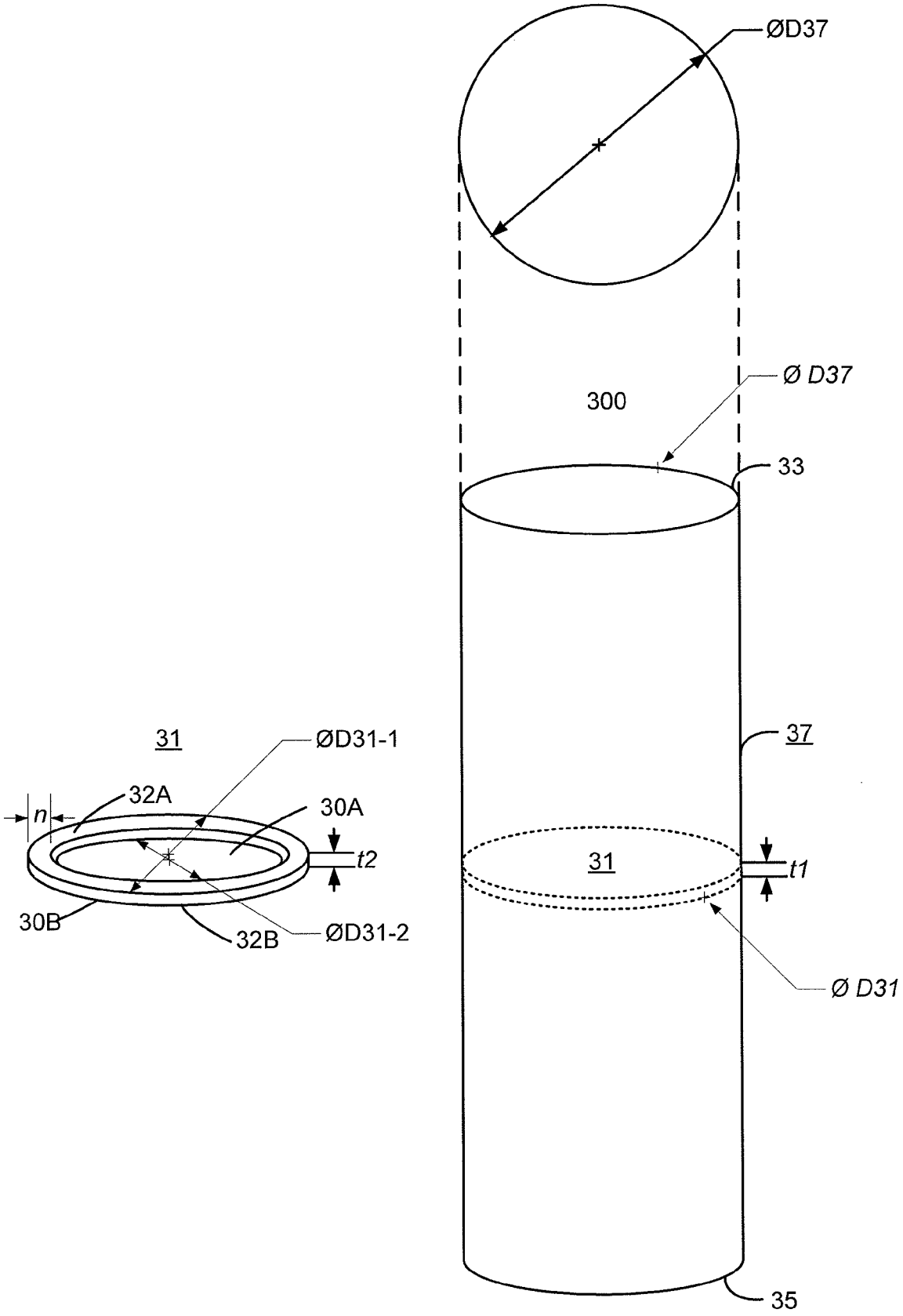
FIG. 4 is an elevation view of one cylinders and connecting-divider for a multi-unit storage device in accordance with an embodiment of the present invention.

FIG. 4 is an elevation view of yet another embodiment of the present invention. Multi-compartment container 300 can include a cylinder 37 having a first end 33 and a second end 35. A multi-compartment container 300 can also include a dividing wall 31. Cylinder 37 can have a diameter D37 dimensioned so that dividing wall 31, having a diameter D31, can slip or snugly fit within the inner diameter of cylinder 37. Dividing wall 31 can be coupled to the inner surface of cylinder 37 by any suitable means including, but not limited to, adhesive, welding, tacks and retaining rings or cylinders.

Dividing wall 31 can be made of any suitable material including, but not limited to, metal, plastic, cardboard, paper board, Mylar, foil or any combination or composite thereof. As shown in FIG. 4, dividing wall 31 can be a simple disk of some thickness t1 and diameter D31. Alternatively, dividing wall 31 can have structural or reinforcement lip sections 32A and 32B similar to that of the connecting-divider shown in FIG. 3. To conserve material and/or increase the structural integrity of the dividing wall 31, the dividing wall 31 can have a solid inner section between the first side 30A and second side 30B having a thickness t1 smaller than the thickness t2 between a surface of lip section 32A and a surface of lip section 32B. The dimension n of the dividing wall 31 can be defined as the difference between diameters D31-1 and D31-2. The dimension n can vary according to the requirements of a multi-compartment container and the materials used to construct dividing wall 31.

In some embodiments, the cylinder 37 and the dividing wall 31 can be molded as a unitary body. For example, the cylinder 37 and dividing wall can be injection molded out of plastic or other moldable as a unitary body. In such embodiments, the walls of the containers can be made of the same material.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A multi-compartment storage device, comprising:

a first cylinder having a first end and a second end, wherein the first cylinder has a substantially uniform diameter from the first end to the second end;

a first lid coupled with the first end of the first cylinder;

a connecting-divider having a first side and a second side, wherein the first side of the connecting-divider is substantially permanently coupled with the second end of the first cylinder;

a second cylinder having a first end and a second end, wherein the second cylinder has a substantially uniform diameter from the first end to the second end; and a second lid coupled with the second end of the second cylinder, wherein the first end of the second cylinder is substantially permanently coupled with the second side of the connecting-divider, and wherein the first and second cylinders comprise a composite material including two or more of: metal, polymer, cardboard, paper board, and foil.

2. The multi-compartment storage device of claim 1 wherein the connecting-divider is coupled with the first and second cylinders with adhesive.

3. The multi-compartment storage device of claim 1 wherein the connecting-divider comprises metal and the composite material comprises cardboard and foil.

4. The multi-compartment storage device of claim 1 wherein the connecting-divider comprises a first lip section on the first side and a second lip section on the second side and wherein the second end of the first cylinder is coupled with the connecting-divider by inserting the second end of the first cylinder into a first region of the first lip section and the first end of the second cylinder is coupled with the connecting-divider by inserting the first end of the second cylinder into a second region of the second lip section.

5. The multi-compartment storage device of claim 4, wherein an interior surface of the first lip section of the connecting-divider extends around an exterior surface of the first cylinder, and wherein an interior surface of the second lip section of the connecting-divider extends around an exterior surface of the second cylinder.

6. The multi-compartment container of claim 5, wherein the interior surface of the first lip section of the connecting-divider is coupled with the exterior surface of the first cylinder with adhesive, and wherein the interior surface of the second lip section of the connecting-divider is coupled with the exterior surface of the second cylinder with adhesive.

7. The multi-compartment storage device of claim 4, wherein the first lip section of the connecting-divider is crimped to engage an exterior surface of the first cylinder, and wherein the second lip section of the connecting-divider is crimped to engage an exterior surface of the second cylinder.

8. The multi-compartment storage device of claim 1, wherein the composite material further includes:

a substrate; and a first layer corresponding to an interior surface of the first and second cylinders, the first layer being continuous from the first end to the second end of the first and second cylinders.

9. The multi-compartment storage device of claim 8, wherein the substrate comprises cardboard, and wherein the first layer comprises foil.

10. The multi-compartment storage device of claim 8, wherein the composite material further comprises a second layer corresponding to an exterior surface of the first and second cylinders, the second layer being continuous from the first end to the second end of the first and second cylinders.

11. The multi-compartment storage device of claim 10, wherein the substrate comprises cardboard, wherein the first layer comprises foil, and wherein the second layer comprises polymer.

12. The multi-compartment storage device of claim 1, wherein the first and second cylinders are sealed by vacuum nitrogen flushing.

13. The multi-compartment storage device of claim 1, wherein the first cylinder has a first diameter, and wherein the second cylinder has a second diameter, the second diameter being different from the first diameter.

14. A multi-compartment storage device, comprising:

a first cylinder having a first end and a second end, wherein the first cylinder has a substantially uniform diameter from the first end to the second end;

a connecting-divider having a first side and a second side, wherein the first side of the connecting-divider is substantially permanently coupled with the second end of the first cylinder; and a second cylinder having a first end and a second end, wherein the second cylinder has a substantially uniform diameter from the first end to the second end, wherein the first end of the second cylinder is substantially permanently coupled with the second side of the connecting-divider, and wherein the first and second cylinders comprise a composite material including:

a substrate including one of: a metal, a polymer, a cardboard, a paper board, and a foil; and an inner layer including a different one of: the metal, the polymer, the cardboard, the paper board, and the foil, the inner layer corresponding to an interior surface of the first and second cylinders, and the inner layer being continuous from the first end to the second end of the first and second cylinders.

* * * * *